US009163504B2

(12) United States Patent
Jairam

(10) Patent No.: US 9,163,504 B2
(45) Date of Patent: Oct. 20, 2015

(54) AXIALLY ROTATING FREE PISTON

(76) Inventor: Raju Jairam, Fort Collins, CO (US)

( * ) Notice: Subject to any disclaimer, the term of this patent is extended or adjusted under 35 U.S.C. 154(b) by 802 days.

(21) Appl. No.: 13/066,723

(22) Filed: Apr. 21, 2011

(65) Prior Publication Data

US 2011/0259188 A1 Oct. 27, 2011

Related U.S. Application Data

(60) Provisional application No. 61/342,969, filed on Apr. 21, 2010.

(51) Int. Cl.

| | |
|---|---|
| ***F01B 3/04*** | (2006.01) |
| ***F01B 3/00*** | (2006.01) |
| ***F01B 3/08*** | (2006.01) |
| ***F01B 9/06*** | (2006.01) |

(52) U.S. Cl.

CPC ..... *F01B 3/0079* (2013.01); *F01B 3/08* (2013.01); *F01B 9/06* (2013.01)

(58) Field of Classification Search

CPC ..... F01B 3/0079; F01B 3/04; F01B 9/04
USPC ..... 92/31, 136
See application file for complete search history.

(56) References Cited

U.S. PATENT DOCUMENTS

| | | | | |
|---|---|---|---|---|
| 1,005,763 | A * | 10/1911 | Adams | 92/31 |
| 1,657,641 | A | 1/1928 | Pescara | |
| 2,474,336 | A * | 6/1949 | Stone | 92/31 |
| 3,994,632 | A * | 11/1976 | Schreiber | 417/534 |
| 4,409,855 | A | 10/1983 | Kokus | |
| 4,858,486 | A * | 8/1989 | Weyer | 92/31 |
| 5,577,436 | A * | 11/1996 | Kimbara | 92/116 |
| 6,244,226 | B1 | 6/2001 | Berlinger et al. | |
| 7,913,663 | B2 | 3/2011 | Cobbs | |
| 2004/0244762 | A1 | 12/2004 | Schapiro et al. | |
| 2008/0236332 | A1 | 10/2008 | Hoose et al. | |
| 2009/0064410 | A1 | 3/2009 | Cohen et al. | |
| 2011/0162467 | A1 | 7/2011 | Niccolai | |
| 2011/0239642 | A1 | 10/2011 | Schwiesow et al. | |
| 2012/0272759 | A1 | 11/2012 | Kim | |
| 2013/0014602 | A1 | 1/2013 | Villalobos | |

OTHER PUBLICATIONS

U.S. Appl. No. 61/342,969, filed Apr. 21, 2010.
Pesri. Developing the Free-Piston Engine from scratch—rotating design. On-line website; https://www.pesri.net.blog; originally downloaded Feb. 25, 2014, 2 total pages.
Google. Rotating free piston. On-line search; https://www.google.com, originally downloaded Feb. 25, 2014, 9 total pages.
Mikalsen et al. A review of free-piston engine history and applications. Applied Thermal Engineering, vol. 27, issue 14-15, Oct. 2007, pp. 2339-2352.

* cited by examiner

*Primary Examiner* — F. Daniel Lopez
(74) *Attorney, Agent, or Firm* — Craig R. Miles; CR Miles P.C.

(57) ABSTRACT

A piston slidably engaged in relation to the longitudinal axis of a shaft rotationally journaled proximate opposed ends to a housing which allows reciprocal travel of the piston within a cylinder of the housing with the external surface of the piston and the internal surface of the cylinder providing mated portions of a piston rotation generation assembly which induces rotation of the piston within the cylinder during reciprocal travel of the piston along the length of the shaft with the piston having rotationally fixed engagement with the shaft such that rotation of the piston within the cylinder generates a corresponding rotation of the shaft.

14 Claims, 10 Drawing Sheets

AXIALLY ROTATING FREE PISTON

This United States Non-Provisional patent application claims the benefit of U.S. Provisional Patent Application No. 61/342,969, filed Apr. 21, 2010, hereby incorporated by reference herein.

I. FIELD OF THE INVENTION

A piston slidably engaged in relation to the longitudinal axis of a shaft rotationally journaled proximate opposed ends to a housing which allows reciprocal travel of the piston within a cylinder of the housing with the external surface of the piston and the internal surface of the cylinder providing mated portions of a piston rotation generation assembly which induces rotation of the piston within the piston chamber during reciprocal travel of the piston along the length of the shaft with the piston having rotationally fixed engagement with the shaft such that rotation of the piston within the piston chamber generates a corresponding rotation of the shaft.

II. BACKGROUND OF THE INVENTION

Conventional methods used to convert linear motion to rotary motion typically utilize a reciprocating member coupled by a connecting member to a crank throw having an axis offset from the axis of a crankshaft. Reciprocal travel of the reciprocating member correspondingly generates reciprocal travel in the connecting member which drives the crank throw about the axis of the crankshaft thereby generating rotary motion of the crankshaft. A wheel can be coupled to the crankshaft to reduce pulsation characteristics of reciprocal travel of the reciprocating member and can further include a vibration dampener to reduce torsion vibration caused by reciprocal forces acting on the torsional elasticity in the crankshaft. Conversion of linear motion to rotary motion by such conventional devices and methods may result in a substantial loss of energy.

Attempts to avoid or reduce energy loss in translating linear motion into rotary motion include the use of various devices such as a swash plate that replaces the common crankshaft with a circular plate (such as a swash plate engine). Pistons press down on the plate in sequence, forcing it to nutate around its center. Further innovations include turbines in which blades coupled to a rotatable shaft may be turned by a flow of gases and the rotary engine in which a rotor coupled to a rotatable shaft turns within a epitrochoid-shaped housing in response to the expansion of gases (such as the Wankel engine) or by use of dual cylinders as in the Geared Cam type engine. Torroidal engines use expanding and contracting vanes within the cylinder producing variable chambers for the expanding gases. A more recent attempt to convert linear motion directly into circular motion is the wedge cam design as described in U.S. Pat. No. 4,409,855.

However, prior to the instant invention there were substantial unresolved problems associated with these conventional technologies. Despite improvements in those technologies which utilize a crankshaft, the loss of efficiency in the transmission and translation of motion from the reciprocating to the rotational component remains substantial. With respect to rotary engines, swash plate engines, and dual chamber geared cam or torroidal engines substantial power loss occurs at the contact area which provides the seal between the moving vanes or chamber and the outer cylinder which outweigh the mechanical losses which occur in the conventional piston engine. Turbine engines which exhibit greater efficiency can be expensive to build and cost prohibitive to operate. Consequently these and other engines are limited to specific applications and are not common in ordinary applications.

II. SUMMARY OF THE INVENTION

Accordingly, a broad object of the invention can be to provide a piston slidably engaged with respect to the longitudinal axis of a shaft rotationally journaled proximate opposed ends to a housing which allows reciprocal travel of the piston within a cylinder of the housing with the external surface of the piston and the internal surface of the piston chamber configured to induce rotation of the piston within the piston chamber during reciprocal travel of the piston along the length of the shaft with the piston having rotationally fixed engagement with the shaft such that rotation of the piston within the piston chamber generates a corresponding rotation of the shaft.

Another broad object of the invention can be to provide an engine, tool, appliance, or other device which incorporates the resulting rotary and translatory motions of axially rotating piston described herein.

Naturally, further objects of the invention may be disclosed throughout other areas of the specification, drawings, photographs, and claims.

III. A BRIEF DESCRIPTION OF THE DRAWINGS

IV. DETAILED DESCRIPTION OF THE PREFERRED EMBODIMENTS

Figure 1:
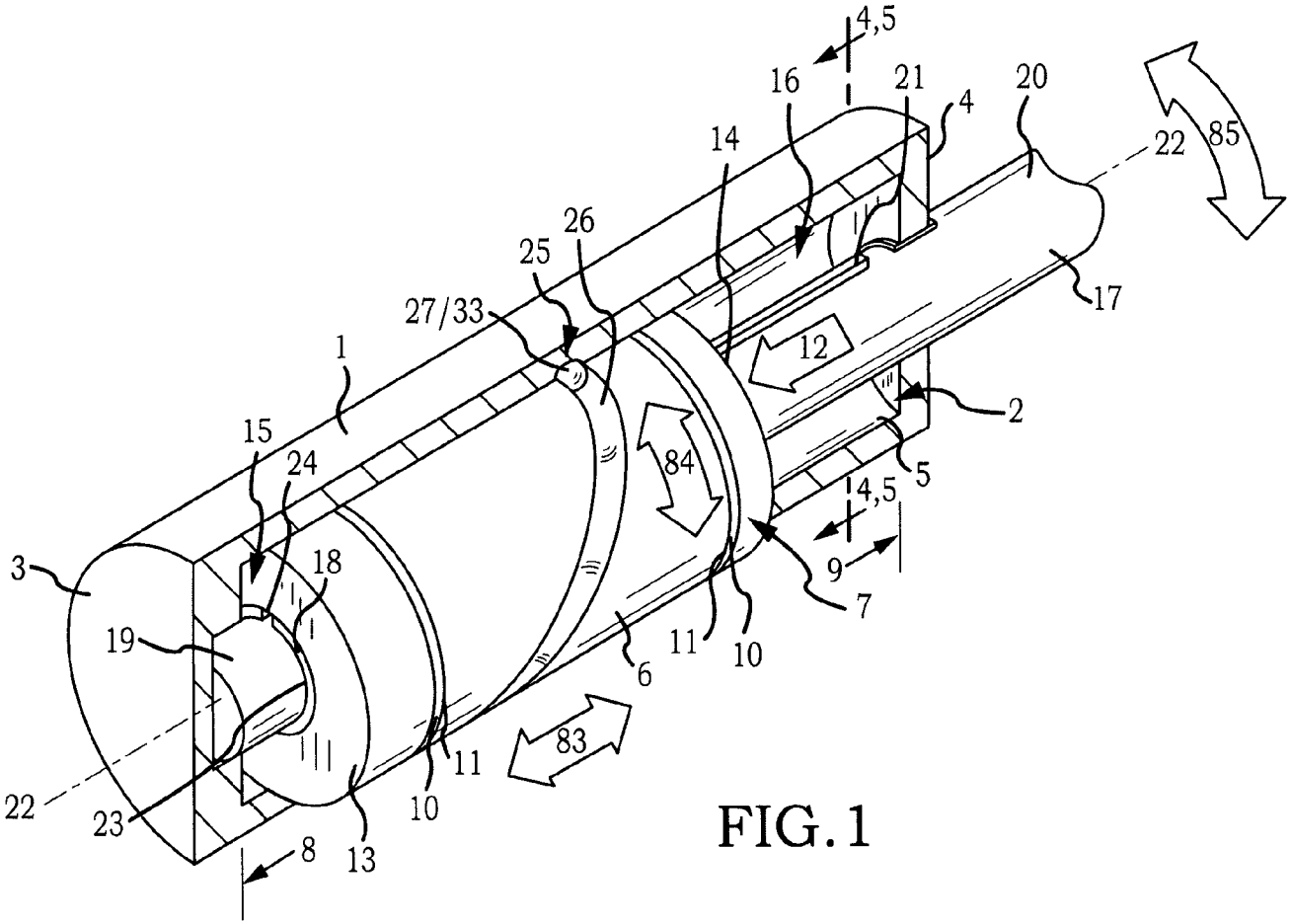
FIG. 1 is perspective partial cross section of a particular embodiment of the invention.
Figure 2:
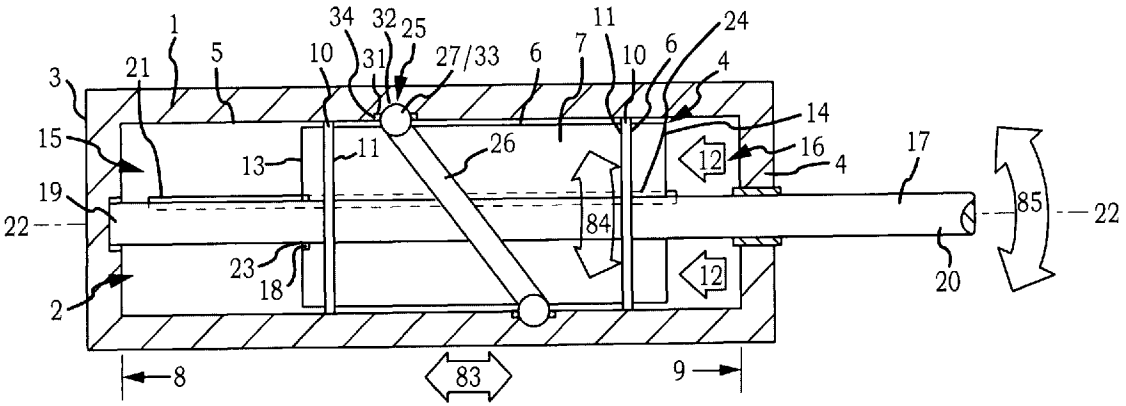
FIG. 2 is side view partial cross section of a particular embodiment of the invention.
Figure 3:
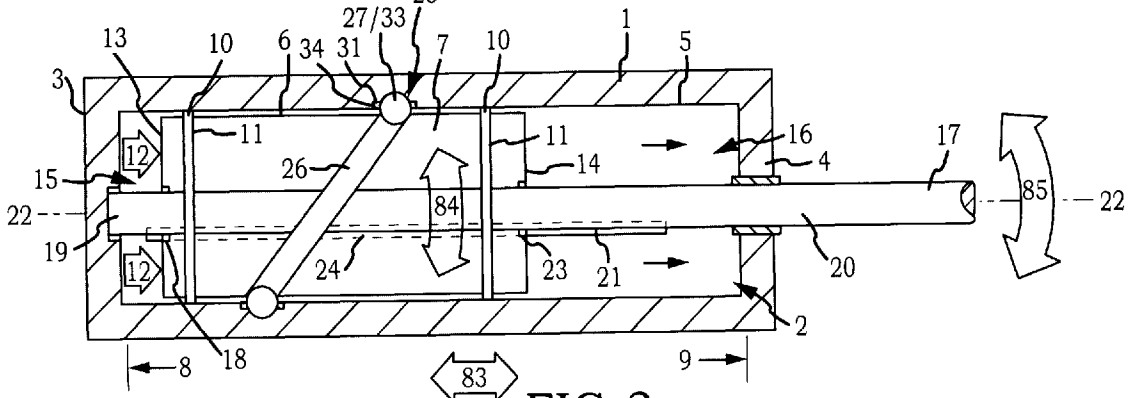
FIG. 3 is side view partial cross section of a particular embodiment of the invention.
Figure 4:
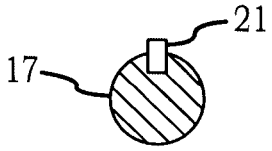
FIG. 4 is a cross section view of a shaft of the particular embodiment of the invention shown in FIG. 1.
Figure 5:
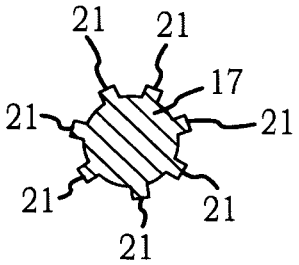
FIG. 5 is a cross section view of an alternative embodiment of the shaft which can be utilized with embodiments of the invention.

Now referring primarily to FIGS. 1 through 3, which provide a general overview of embodiments of the invention which can include a housing (1) which defines within a cylinder (2) having a length disposed between a first cylinder head (3) and a second cylinder head (4). The cylinder (2) can have a cylinder wall (5) having slidably sealed engagement with the cylindrical external surface (6) of a piston (7) (also referred to as the "first piston") which allows the piston (7) to reciprocally travel (83) a distance between a first location (8) and a second location (9) within the cylinder (2). The distance between the first location (8) and the second location (9) can vary depending upon the embodiment and application of the invention. The slidably mated surfaces of the cylinder (2) and the piston (7) can be engaged in whole or in part whether directly or indirectly by one or more annular rings (10) fitted in corresponding annular grooves (11) of the piston (7); although the invention is not so limited. The piston (7) can be sufficiently sealed to allow pressure (12) acting on the first face (13) or the second face (14) of the piston (7) to correspondingly generate travel of the piston (7) within the cylinder (2) between the first location (8) and the second location (9). The piston (7) and the pair of cylinder heads (3)(4) defining a first chamber (15) and a second chamber (16) within the cylinder (2).

Now referring primarily to FIGS. 1 through 5, embodiments of the invention can further include a shaft (17) rotationally journaled proximate a first shaft end (19) and second shaft end (20) to a corresponding one of the first cylinder head (3) and the second cylinder head (4). The piston (7) can have axial slidably sealed engagement with the shaft (17) (whether engaged in whole or in part or indirectly by one or more shaft seals (18)) which allows the piston (7) to reciprocally travel (83) between a first location (8) and a second location (9) within the cylinder (2) along the longitudinal axis of the shaft (17). The piston (7) being sufficiently sealed in relation the cylinder wall (5) and the shaft (17) to allow sufficient differential pressure between the first chamber (15) and the second chamber (16) alternately acting on opposed first and second faces (13)(14) of the piston (7) to correspondingly generate reciprocal travel (83) of the piston (7) within the cylinder (2) between the first location (8) and the second location (9).

Again referring primarily to FIGS. 1 through 5, the shaft (17) can have one or more spline (21) extending radially outward along the longitudinal axis (22) of the shaft (17) within said cylinder (2). The piston (7) can have an axial passage (23) communicating between the first face (13) and the second face (14). The axial passage (23) can have one or more grooves (24) radially extending outward which correspondingly slidably mates with the spline (21) of the shaft (7) and allows slidable engaged relation of the piston (7) along the longitudinal axis (22) of the shaft (17) while having fixed rotational relation of the piston (7)) about the shaft (17). Accordingly, any axial rotation (84) of the piston (7) which occurs during travel between the first location (8) and the second location (9) within the cylinder (2) can be translated into a corresponding amount of rotation (85) of the shaft (17) within the journals of the first cylinder head (3) and the second cylinder head (4). As non-limiting examples, the shaft (17) can include one or more splines (21), keys, or the like extending radially outward along the longitudinal axis (22) of the shaft (17) each of which can correspondingly slidely engage one or more keyways or grooves (24) of the axial passage (23) communicating between the first face (13) and the second face (14) of the piston (7); however the invention is not so limited, and as to other embodiments of the invention the one or more splines (21), keys, or the like can extend inwardly from the axial passage (23) of the piston (7) correspondingly slidably mated with keyways or grooves (24) extending radially inward along the longitudinal axis (22) of the shaft (17).

Again referring primarily to FIGS. 1 through 5, embodiments of the invention can further include a piston rotation generation assembly (25). Generally, the piston rotation generation assembly (25) includes a slidably mated configuration of the external surface (6) of the piston (7) in relation to the cylinder wall (5) which upon liner travel (83) of the piston (7) in the cylinder (2) between the first location (8) and the second location (9), as above described, generates axial rotation (84) of the piston (7) in relation to the longitudinal axis (22) of the shaft (17). The piston rotation generation assembly (25) can include an annular channel (26) coupled about or cut into the external surface (6) of the piston (7) or the cylinder wall (5) which defines a closed plane curve as would result from the intersection of the piston (7) or the cylinder (2) by a plane which produces a closed curve having bilateral symmetry on either side of a plane longitudinally bisecting the piston (7) or cylinder (2), except that the closed curve would not define a circle (a closed curve defined by a plane intersecting the piston (7) perpendicular to the longitudinal axis) or any other configuration of the annular channel (26) which would not allow the piston (7) to travel between a first location (8) and a second location (9) while generating rotation (84) of the piston (7) in relation to the longitudinal axis (22) of the shaft (17). Any configuration which allows travel in the piston (7) between a first location (8) and a second location (9) and results in some rotation (84) of the piston (7) in relation to the longitudinal axis (21) of the shaft (17) even if not a closed curve or not a closed annular channel (26) could be utilized in certain applications. As one non-limiting example, as shown in the Figures, the annular channel (26) can define an elliptical path.

Now referring primarily to FIGS. 1 through 3, the annular channel (26) in perpendicular cross section can have any configuration capable of slidable mated engagement with a channel guide (27) correspondingly fixedly coupled to the external surface (6) of the piston (7) or the cylinder wall (5) and while the Figures show the annular channel (26) in cross section as terminating in a generally semi-circular channel which mates with a correspondingly configured channel guide (27) having a generally semi-circular terminal end; the invention is not so limited, and the annular channel (26) in perpendicular cross section and the channel guide (27) could have oval, square, rectangular, triangular, truncated triangle, or other slidably matable configurations. The channel guide (27) can coupled in fixed stationary relation to the cylinder wall (5) or the external surface (6) of the piston (7) depending on the embodiment of the invention. As the piston (7) travels between the first location (8) and the second location (9) in the cylinder (2), the channel guide (27) can act on the surfaces of the annular channel (26) to generate an amount of axial rotation of the piston (7) in relation to the longitudinal axis (22) of the shaft (17). As one non-limiting example, the configuration of the annular channel (26) mateably engaged with the channel guide (27) can result in about 180 degrees of rotation in the piston (7) upon travel between the first location (8) and the second location (9) within the cylinder (2). The distance between the first location (8) and the second location (9) can vary with the length of the elliptical path defined by of the configuration of the annular channel (26). The greater the length of the ellipse defined by the configuration of the annular channel (26) the greater the distance between the first location (8) and the second location (9) in the cylinder (2) (the longer the stroke of the piston (7) within the cylinder (2)). Travel between the first location (8) and the second location (9) within the cylinder (2) and from the second location (9) back to the first location (8) can generate one 360° rotation (84) of the piston (7) within the cylinder (2) and a correspondingly one 360° rotation (85) of the shaft (17). Understandably, if the annular channel (26) did not define a closed plane curve or closed elliptical channel, travel of the piston (7) from the first location (8) toward the second location (9) would necessitate rotation of the piston (7) in a first direction and travel from the second location (9) toward the first location (8) would necessitate rotation of the piston (7) in an opposed second direction.

Figure 12:
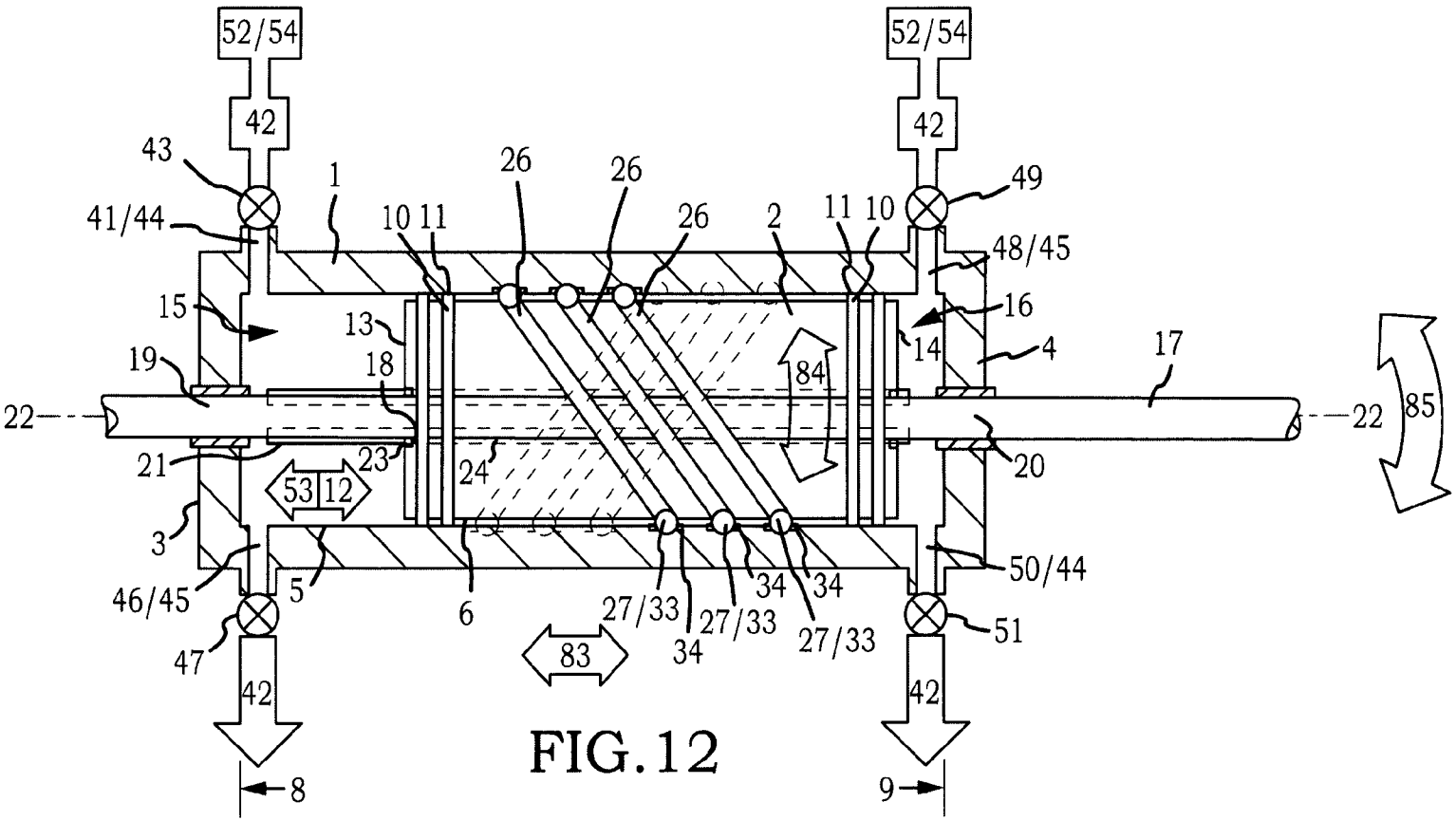
FIG. 12 is a partial cross section view of a particular embodiment of the invention which provides inlet ports and outlet ports which can operate between the open condition and the closed condition by operation of corresponding inlet valves and outlet valves.

Now referring primarily to FIGS. 1 through 3 and 12, with respect to particular embodiments of the invention, the annular channel (26) can be coupled to or cut in the external surface (6) of the piston (7) or cylinder wall (5) of the cylinder (2) with an elliptical path established as shown by the FIGS. 1 through 3; however, the invention is not so limited, and the annular channel (26) can also be established in opposite mirror image relation to that shown by FIG. 2 as shown in FIG. 3, or one or more annular channel(s) (26) can be established in mirror image relation to one or more additional annular channels (26) on the piston (7) or the cylinder wall (5) to balance operational forces exerted on the piston (7), the cylinder wall (5) and the shaft (17) as shown in FIG. 12 (opposed mirror image annular channels (26) shown in broken line). As to those embodiments of the invention having annular channels (26) of generally opposed or mirror image relation, the corresponding channel guide(s) (27) can be placed at the opposed end of the piston (7) travel in order balance operational forces or to guide the piston (7) in the same direction of translation and rotation. Accordingly, as particular embodiments of the piston rotation generation assembly (25) including one or more annular channels (26) coupled or cut into the external surface (6) of the cylinder wall (5) and the corresponding channel guide(s) fixedly coupled to the external surface (6) of the piston (7). The general configuration of the annular channel (26) and the channel guide (27) and operation being similar to that above described.

Figure 6:
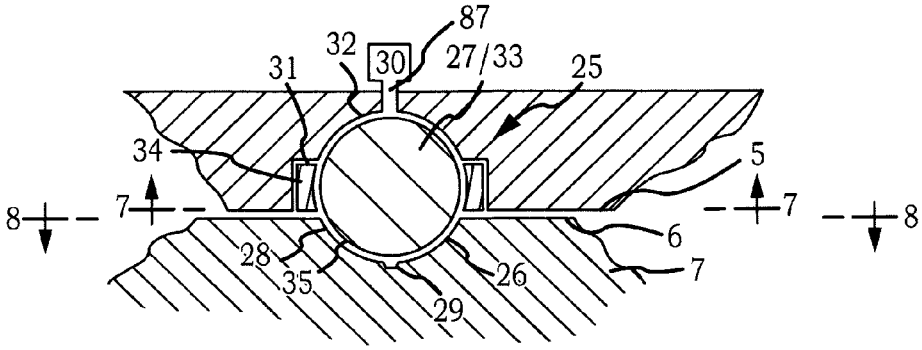
FIG. 6 is cross section view of a particular embodiment of a piston rotation generation assembly utilized in the embodiments of the invention shown in FIGS. 1 through 3.
Figure 7:
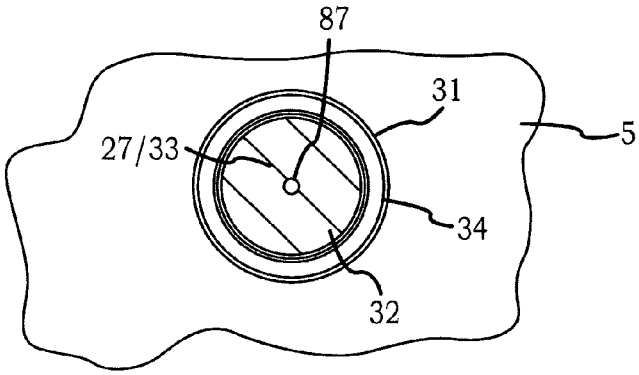
FIG. 7 is a plan view of the hemispherical socket and seat of the particular embodiment of the piston rotation assembly shown in FIG. 6.
Figure 8:
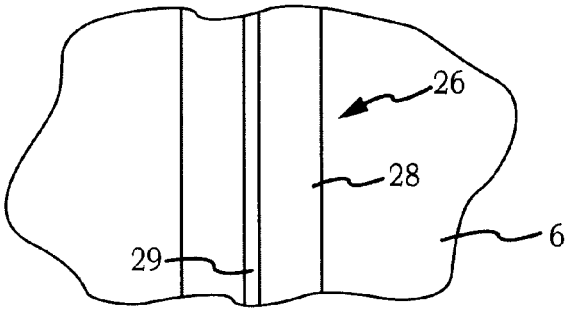
FIG. 8 is a partial plan view of the annular channel of the particular embodiment of the piston rotation assembly shown in FIG. 6.

Now referring primarily to FIGS. 6 through 8, which shows a cross sectional view of a particular non-limiting embodiment of the piston rotation generation assembly (25) having an annular channel (26) coupled or cut into the external surface (6) of the piston (7) and the channel guide (27) having a stationary fixed location on the cylinder wall (5) of the cylinder (2), the annular channel (26) in cross section can have a generally semicircular configuration (28). The semicircular configuration (28) of the annular channel (26) can further include one or more lubricating groove(s) (29) which allow an amount of lubricant (30) to be received between the contact surfaces of the annular channel (26) and the channel guide (27). The amount of lubricant (30) can be provided through a lubricant port (87) from a lubricant source (88).

Figure 9:
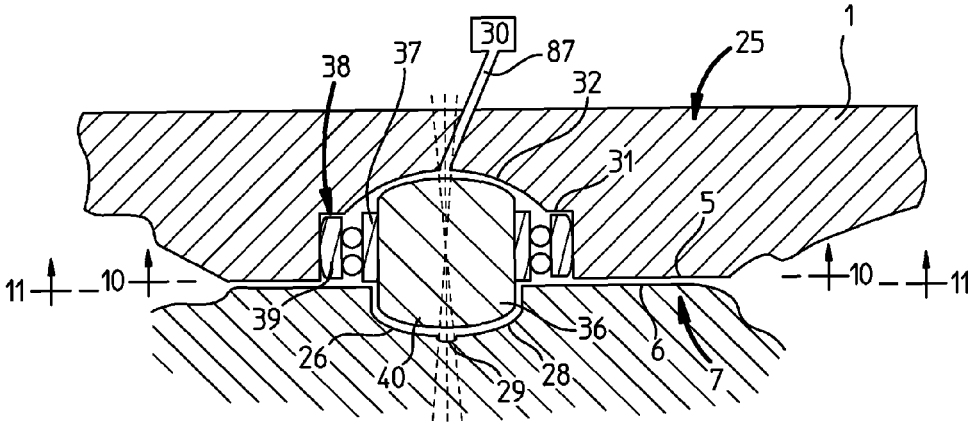
FIG. 9 is cross section view of a particular embodiment of a piston rotation assembly.

As to the particular embodiment of the channel guide (27) shown in FIGS. 6 and 9, the channel guide (27) can be provided as a cylindrical seat (31), a hemispherical socket (32), and a roller bearing (33) received in the hemi-spherical socket (32). The cylindrical seat (31) and hemi-spherical socket (32) can be machined in cylinder wall (5) of the cylinder (2) to receive and anchor a race (34) of a roller bearing (33). The race (34) of the roller bearing (33) mounted in the cylindrical seat (31) can locate a sufficient portion of the spherical surface (35) of the roller bearing (33) to mate within the annular channel (26) for operation of the piston (7) as above described. FIG. 7 shows a top view of the particular embodiment of a channel guide (27) which utilizes the roller bearing (33) as above-described and FIG. 8 shows a top view of the particular embodiment of the annular channel (26) configured to mate with a portion of the roller bearing (33).

Figure 10:
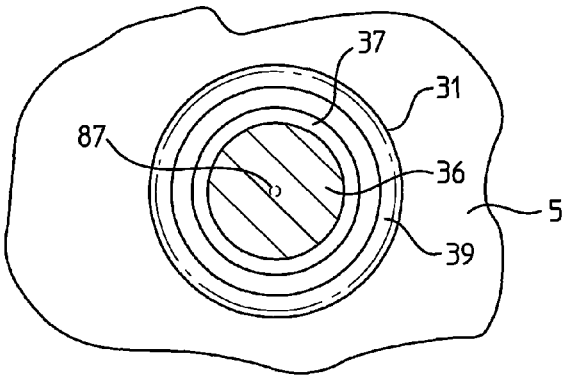
FIG. 10 is a plan view of the hemispherical socket and seat of the particular embodiment of the piston rotation assembly shown in FIG. 9.
Figure 11:
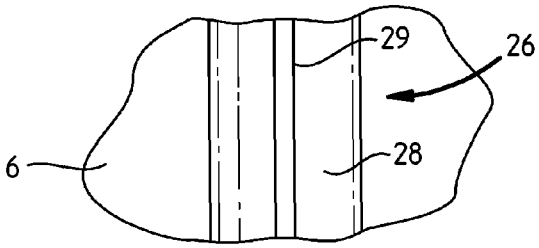
FIG. 11 is a partial plan view of the annular channel of the particular embodiment of the piston rotation assembly shown in FIG. 9.

Now referring to FIGS. 9-11, an alternate embodiment of the piston rotation generation assembly (25) is shown which provides a peg (36) mounted inside an inside race (37) of a self aligning bearing (38) with the outside race (39) of the self aligning bearing (38) received by a cylindrical seat (31) and generally hemispherical socket (32) coupled to the cylinder wall (5) of the cylinder (2). The peg (36) in cross-section terminating in semi-circular terminal end (40) (or hemispherical end) which slidely matedly engages the corresponding semicircular configuration (28) of the annular channel (26). FIG. 10 shows a top view of the particular embodiment of a channel guide (26) which utilizes the peg (36) as above-described and FIG. 11 shows a top view of the particular embodiment of the annular channel (26) configured to mate with a portion of the pin (36) in a manner similar to that above-described for the roller bearing (33).

Now referring primarily to FIG. 12, embodiments of the invention can further include a first inlet port (41) opening into the first chamber (15). The first inlet port (41) having a constructional form which allows an amount of fluid (42) to be delivered through the first inlet port (41) to the first chamber (15). As to certain embodiments, a first inlet valve (43) can be operatively associated with the inlet port (41) to alternately provide an open condition (44) and a closed condition (45) of the first inlet port (41) in regard to delivery of the amount of fluid (42) to the first chamber (15). The amount of fluid (42) delivered to the first chamber (15) occurring in the open condition (44) of the first inlet port (41).

Embodiments of the invention can further include a first outlet port (46) having a constructional form which allows the amount of fluid (42) to egress the first chamber (15) through the first outlet port (46). As to certain embodiments, a first outlet valve (47) can be operatively associated with the first outlet port (46) to alternately provide the open condition (44) and a closed condition (45) of the first outlet port (46) in regard to egress of the amount of fluid (42) from the first chamber (15). Egress of the amount of fluid (42) from the first chamber (15) occurs in the open condition (44) of the first outlet port (46).

Again referring primarily to FIG. 12, embodiments of the invention can further include a second inlet port (48) opening into the second chamber (16). The second inlet port (48) having a constructional form which allows an amount of fluid (42) to be delivered through the second inlet port (48) to the second chamber (16). As to certain embodiments, a second inlet valve (49) can be operatively associated with the second inlet port (48) to alternately provide the open condition (44) and a closed condition (45) of the second inlet port (48) in regard to delivery of the amount of fluid (42) to the second chamber (16). The amount of fluid (42) delivered to the second chamber (16) occurring in the open condition (44) of the second inlet port (48).

Embodiments of the invention can further include a second outlet port (50) having a constructional form which allows the amount of fluid (42) to egress the second chamber (16) through the second outlet port (50). As to certain embodiments, a second outlet valve (51) can be operatively associated with the second outlet port (50) to alternately provide an open condition (44) and a closed condition (45) of the second outlet port (50) in regard to egress of the amount of fluid (42) from the second chamber (16). Egress of the amount of fluid (42) from the second chamber (16) occurs in the open condition (44) of the second outlet port (50).

Accordingly, certain embodiments of the invention, may only have a first inlet port (41) for ingress of an amount of fluid (42) to the first chamber (15) and the first inlet port (41) may also be utilized for egress of the amount of fluid (42) from the first chamber (15) and the second chamber (16) may not provide a corresponding second inlet port (48). As to other embodiments of the invention, the second chamber (16) and the cylinder head (4) may be entirely omitted along with the corresponding length of the cylinder (2) and shaft (17) which can allow for use of the invention in varied an numerous applications such as power tools, appliances and similar devices that can capitalize on the resulting rotary and translatory motions. As to other embodiments, both a first inlet port (41) and a first outlet port (46) may correspondingly provide for ingress and egress of the amount of fluid (42) in relation to the first chamber (15), while the second chamber (16) may not provide a corresponding second inlet port (48) and a second outlet port (50) or may be open to the atmosphere. Yet other embodiments may correspondingly provide a first inlet valve (43) operatively associated with the first inlet port (41) and may further include the first outlet valve (47) operatively associated with the first outlet port (46), while the second chamber may not provide a corresponding second inlet valve (49) or second outlet valve (51). Yet as to other embodiments, the second chamber (16) can further include the second inlet port (48), or a second inlet port (48) and a second outlet port (50), or a second inlet port (48) and a second outlet port (50) each correspondingly providing a second inlet valve (49) and a second outlet valve (51), in various permutations and combinations. While the Figures generally show each of the first chamber (15) and the second chamber (16) and greater numbers of chambers depending on the number of pistons (7) in the cylinder (2) each having an inlet port (41)(48) and an outlet port (46)(50) and each having an inlet valve (43)(49) and an outlet valve (47)(51); the invention is not so limited each of the examples can be configured to operate in any of the various permutations and combinations with or without inlet ports (41)(48), outlet ports (46)(50), inlet valves (43)(49) or outlet valves (47)(51) depending upon the application.

The amount of fluid (42) can be delivered to the first chamber (15) with sufficient pressure (12) to act on the first face (13) of the first piston (7) with sufficient forcible urging to generate sliding engagement of the first piston (7) along the longitudinal axis (22) of the shaft (17) toward the second location (9) in the cylinder (2). The pressure (12) of the amount of fluid (42) can be sufficiently relieved in the first chamber (15) (or a partial vacuum (53) can be generated in the first chamber (15)) to allow the first piston (7) to generate sliding engagement of the piston along the longitudinal axis (22) of the shaft toward the first location (8). Sufficient pressure (12) of the amount of fluid (42) (whether a liquid or a gas) can be generated with a pressure generator (52) in the form of a compressed liquid or gas, or a pump which generates a flow of the amount of fluid (42) at sufficient pressure, or the like. Similarly, sufficient vacuum (53) can be generated in the first chamber (15) by a fluidicly coupled vacuum generator (54) in the form of a vacuum pump, or the like.

As to certain embodiments, the amount of fluid (42) can be delivered through the first inlet port (41) in the open condition (44) to the first chamber (15) while the first outlet port (46) can be in the closed condition (45) allowing the amount of fluid (42) to act on the first face (13) of the first piston (7) to generate sliding engagement of said first piston (7) along the longitudinal axis (22) of the shaft (17) from the first location (8) to the second location (9). Similarly, as to travel of the first piston (7) from the second location (9) toward the first location (8), the first inlet port can be in the closed condition (45) while the first outlet port (46) can be in the open condition (44), such that the first face (13) of the first piston (7) can act on the amount of fluid (42) in the first chamber (15) to result in egress of substantially all of the amount of fluid (42) through the first outlet port (46). The cycle can be repeated with each movement of the first piston (7) between the first location (8) and the second location (9) or with sufficient frequency to generate a desired velocity of travel of the first piston (7) between the first location (8) and the second location (9) or the desired revolutions of the shaft (17) in a period of time.

As to certain embodiments, an amount of fluid (42) can be delivered through the first inlet port (41) in the open condition (44) to the first chamber (15) and delivered through the second inlet port (48) in the open condition (44) to the second chamber (16) with the open condition (44) of said first inlet port (41) and the open condition (44) of said second inlet port (48) in alternate timed relation to allow the amount of fluid (42) to alternately act on the first face (13) of the first piston (7) and the second face (14) of the first piston (7) to generate sliding engagement of the first piston (7) in alternating opposite direction along the longitudinal axis (22) of the shaft (14) to generate axial rotation of the first piston (7) in the cylinder (2) and corresponding rotation of the shaft (17).

Figure 13:
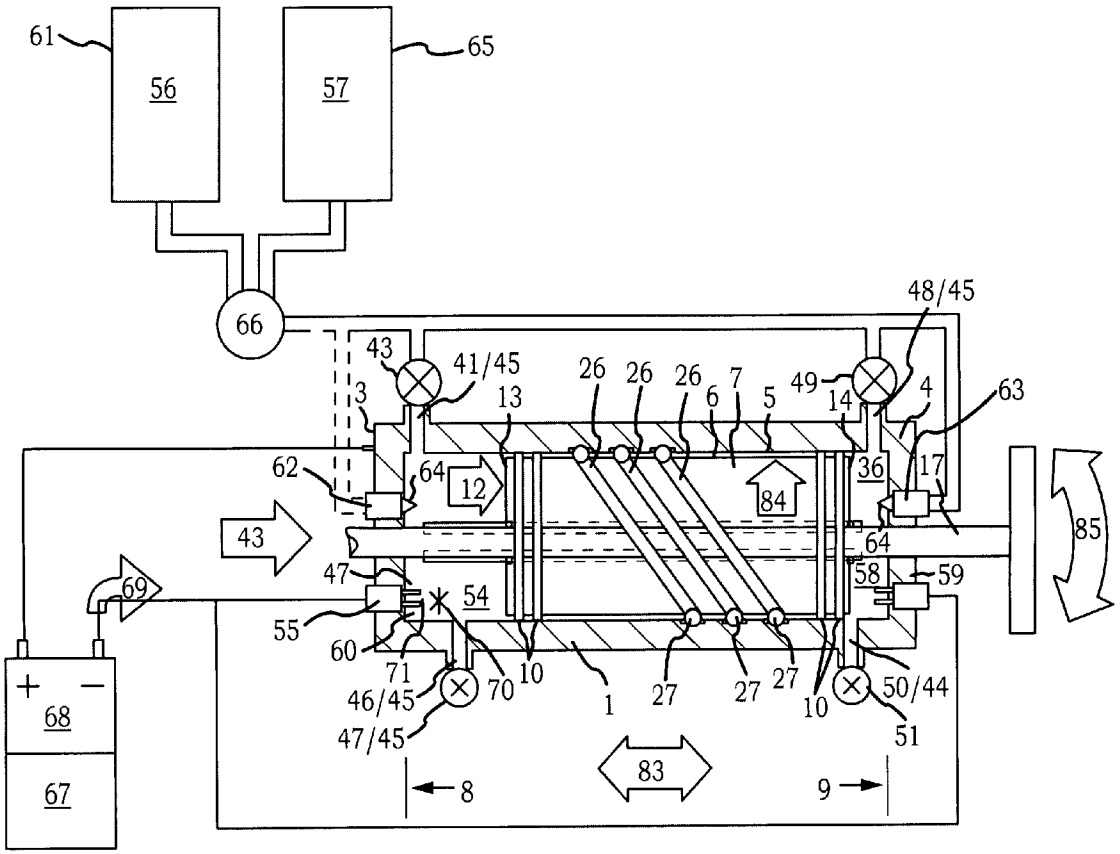
FIG. 13 is a partial cross section view of a particular embodiment of the invention which combusts a mixture of an amount of fuel and an amount of oxidizer to generate travel in a piston located between two combustion chambers having a four cycle operation.

Now referring primarily to FIG. 13, the first chamber (15) can comprise a first combustion chamber (54) which can further include a first ignition plug (55) having an electrode (60) within the first combustion chamber (54). An amount of fuel (56) can be mixed with an amount of oxidizer (57) and combustion of the amount of fuel (56) mixed with the amount of oxidizer (57) by the first ignition plug (55) can result in an expansion of gases the pressure (12) acting on the first face (13) of the first piston (7) to generate sliding engagement of the first piston (7) along the longitudinal axis (22) of the shaft (17). As to certain embodiments, a first fuel injector (62) can be coupled to the first cylinder head (3) which operates to periodically inject an amount of fuel (56) into the first combustion chamber (54).

Similarly, the second chamber (16) can comprise a second combustion chamber (58) which can further include a second ignition plug (59) having an electrode (60) within the second combustion chamber (58). Alternate timed combustion of the amount of fuel (56) mixed with said amount of oxidizer (57) in the first combustion chamber (54) and the second combustion chamber (58) by corresponding timed operation of the first ignition plug (55) and the second ignition plug (59) can result in an increased pressure (12) of the expansion of gases which alternately act on the first face (13) of the first piston (7)

and on the second face (14) of the first piston (7) to generate sliding engagement of the piston (7) along the longitudinal axis (22) of the shaft (17).

Again referring to FIG. 13, internal combustion of an amount of fuel (56) generates pressure (12) by expanding gases within each of the first combustion chamber (54) and the second combustion chamber (58) defined by a first piston (7) and the pair of cylinder heads (3)(4) to generate travel of the first piston (7) within the cylinder (2) between the first location (8) and the second location (9) and back to the first location (8) which when repeated correspondingly generates rotation of the shaft (17), as above described. As to this particular embodiment of the invention, an amount of fuel (56) such as gasoline, liquefied natural gas, alcohol, hydrogen, nitrous oxide, or the like, can be delivered from a fuel source (61) such as a fuel tank, gas cylinder, or the like, into each of the two opposed combustion chambers (15)(16) through a corresponding first inlet port (41) and a second inlet port (48) in timed alternating fashion by way of operation of the first inlet valve (43) and the second inlet valve (49).

Alternately, as to particular embodiments, a first fuel injector (62) and a second fuel injector (63) can be correspondingly coupled to the first cylinder head (3) and the second cylinder head (4) each having a fuel injector inlet (64) within the corresponding first combustion chamber (15) and the second combustion chamber (16) which provide timed alternate delivery of an amount of fuel (56) into each of the first combustion chamber (15) and the second combustion chamber (16).

An oxidant source (65) such the atmosphere, a gas cylinder, or the like, can deliver an amount of oxidizer (57) such as air, oxygen, or partial pressures of gases including an amount of oxygen, or the like, into each of the two opposed combustion chambers (15)(16) through the corresponding first inlet port (41) and second inlet port (48) valved (43)(51) to allow timed alternating delivery to the opposed combustion chambers (15)(16). As to certain embodiments of the invention the first inlet port (41) and the second inlet port (48) can deliver both the amount of fuel (56) and the amount of oxidizer (57) mixed by a fuel-oxidant regulator (66) such as a carburetor or the like, in a ratio which allows combustion of the amount of fuel (56) in the each combustion chamber (15)(16). As to other embodiments, the amount of fuel (56) can be delivered through the fuel injector inlets (64) of the first fuel injector (62) and the second fuel injector (63) into the corresponding first combustion chamber (15) and the second combustion chamber (16) while the amount of oxidizer (57) can be delivered through the first inlet port (41) and the second inlet port (48). The timed delivery of the amount of fuel (56) and the amount of oxidizer (57) to each of the first combustion chamber (54) and the second combustion chamber (58) and timed ignition of the amount of fuel (56) and the amount of oxidizer (57) in relation to the open condition (44) and closed condition (45) of the inlet valves (43)(49) and outlet valves (47)(51) and travel of the first piston (7) can be coordinated by way of a fuel ignition controller (67).

Figure 14:
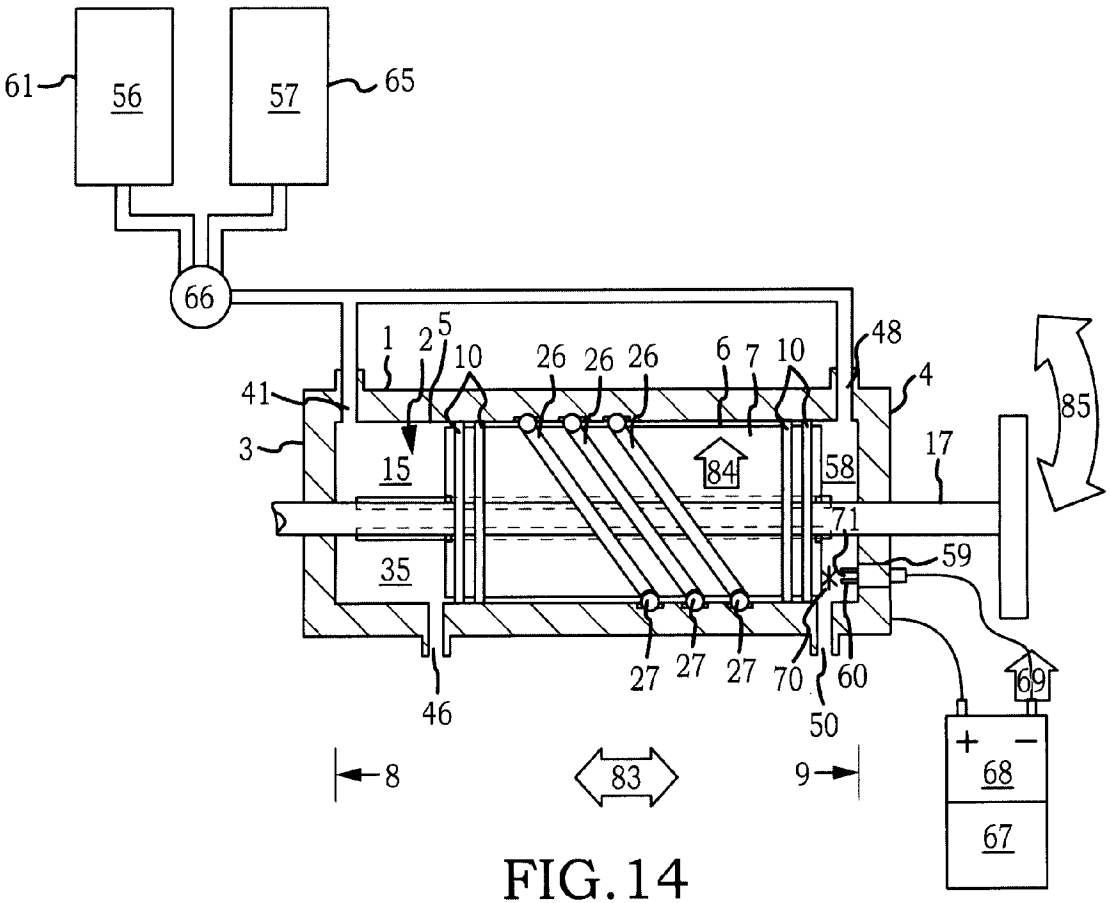
FIG. 14 is a partial cross section view of a particular embodiment of the invention which combusts a mixture of an amount of fuel and an amount of oxidizer to generate travel in a piston located between two combustion chambers having a two cycle operation.

Now referring primarily to FIGS. 13 and 14, particular non-limiting embodiments of the invention can further include an electric current generator (68) which generates an electrical current (69) which can be timed in relation to the delivery of the mixture of fuel (56) and oxidant (57) to each of the opposed combustion chambers (54)(58) and ignition in relation to the position of piston (7) to coordinate translation of the pressure (12) of expansion of gases resulting from combustion of the amount of fuel (56) in the corresponding one of the combustion chambers (54)(58) into rotational motion of the shaft (17). The electrical current (69) can be sufficient to generate a discharge (70) (or spark) across a gap (71) of a corresponding electrode (60) within the corresponding one of the combustion chambers (54)(58) timed to ignite the amount of fuel (56) delivered to each of the opposed combustion chambers (54)(58). The electric current generator (68) can be coupled the fuel ignition controller (67) which can function to generate and time the discharge (70) (spark) across the gap (71) of the one or more of the electrodes (60) and can take a conventional constructional form such as a battery, a magneto system in which the engine spins a magnet inside a coil, ignition coil and distributor, electronic ignition (whether analog or digital), engine management system, or the like.

Now referring primarily to FIGS. 13 and 14, which show a comparison between the embodiments of the invention configured to operate in a four stroke cycle as shown in FIG. 13 and configured to operate in a two stroke cycle as shown in FIG. 14. As a non-limiting example, operation of particular embodiments of the invention can have a four stroke cycle (which can be similar in operation to the four stroke cycle of conventional internal combustion engines) which in a first stroke, the piston (7) travels from the first location (8) to the second location (9) in the cylinder (2) reducing the pressure inside the first of the opposed combustion chambers (54)(58). A mixture of fuel (56) and oxidizer (57) can be drawn into or forced by atmospheric (or greater) pressure into the combustion chamber (54) or (58) through the corresponding inlet port (41) or (48). The inlet port (41) or (48) can then established in the closed condition (45) by operation of the corresponding inlet valve (43)(49). In a second stroke, with both inlet port (41) and the corresponding outlet port (46) in the closed condition (45), the piston (7) travels from the second location (9) to the first location (8) in the cylinder (2) compressing the mixed amount of fuel (56) and amount of oxidizer (57) in the combustion chamber (54). In a third stroke, the compressed mixed amount of fuel (56) and amount of oxidizer (57) can be ignited by the discharge (70) across the gap (71) of the corresponding electrode (60), or in particular embodiments the heat and pressure of compression. The resulting massive increase in pressure (12) from the combustion of the compressed amount of fuel (56) and amount of oxidizer (57) drives the piston (7) back toward the second location (9) with tremendous force. In a fourth stroke, the piston (7) once again travels to the first location (8) with the outlet port (46) established in the open condition open (44). This action evacuates the products of combustion from the combustion chamber (15) or (16) by pushing the spent fuel (56) and oxidizer (57) mixture through the outlet port (46) in the open condition (44).

Now referring primarily to FIG. 14, which shows an embodiment of the invention configured to operate in a two stroke cycle which can have similarities to the two stroke cycle of conventional engines. In the two stroke configuration, the inlet port (43) or (48) and the outlet port (46) or (50) may not be valved, which simplifies their construction and lowers the weight of the invention. In a first stroke, the piston (7) travels from the first location (8) toward the second location (9) uncovering the corresponding inlet port (43) or (48) of the corresponding combustion chamber (54) or (58) and reducing pressure (12) within the combustion chamber (54) or (58). A mixture of an amount of fuel (56) and an amount of oxidizer (57) can be drawn into or delivered under pressure into the combustion chamber (54) or (58) displacing the remaining products of combustion from the prior stroke. In a second stroke, the piston (7) travels from the second location (9) to the first location (8) covering the corresponding inlet port (43) or (48) and outlet port (46) or (50) and compressing the mixed amount of fuel (56) and amount of oxidizer (57) in the combustion chamber (54) or (58) which can be ignited resulting in massive increase in pressure (12) from the combustion of the compressed mixed amount of fuel (56) and amount of oxidizer (57) which can drive the piston (7) back toward the second location (9) with tremendous force. The two stroke cycle having only a compression and combustion stroke.

Figure 16:
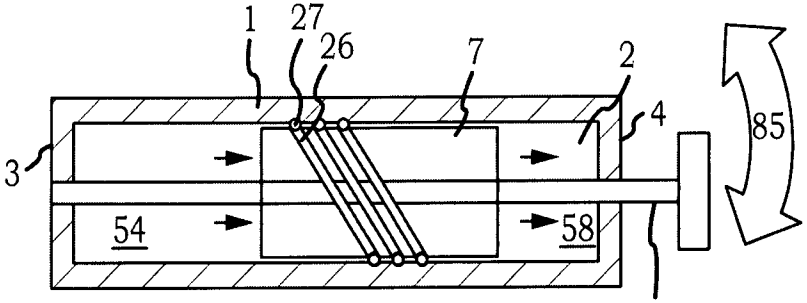
FIG. 16 is a partial cross section view of a particular embodiment of the invention having one piston and two combustion chambers.
Figure 15:
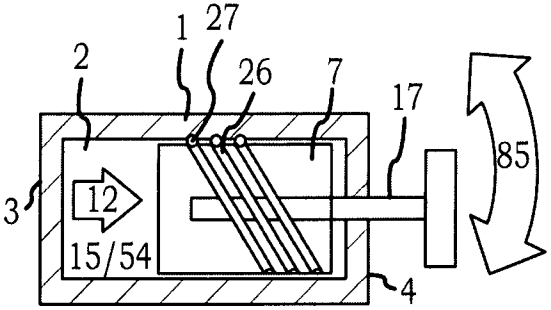
FIG. 15 is a partial cross section view of a particular embodiment of the invention having one piston and one combustion chamber.
Figure 17:
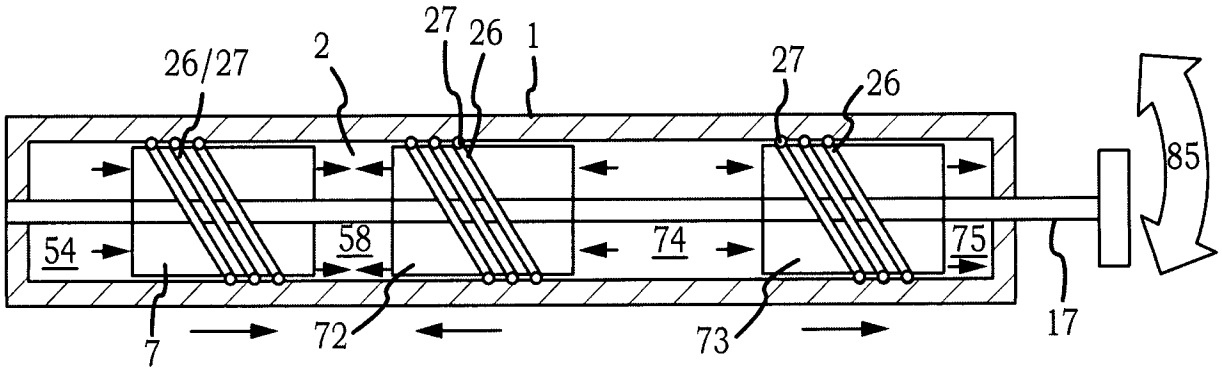
FIG. 17 is a partial cross section view of a particular embodiment of the invention having one three pistons and four combustion chambers.

Now referring primarily to FIGS. 15, 16, and 17 which show particular embodiments of the invention which respectively provide one piston (7) and one combustion chamber (54) (or chamber (15)), one piston (7) and two combustion chambers (54)(58) (or chambers (15)(16)) and three pistons (7)(72)(73) and four combustion chambers (54)(58)(74)(75) (or chambers). As shown in FIG. 15 one piston (7) can travel between a first location (8) and a second location (9) within a cylinder (3). A mixture of fuel (56) and oxidizer (57) can be introduced and combusted on only a single side of the piston (7) defining that portion of the cylinder (2) as a combustion chamber (54). As shown in FIG. 16, one piston (7) can travel between a first location (8) and a second location (9) with fuel (56) and oxidizer (57) alternatingly introduced and combusted on opposed sides of the piston (7) defining each of those portions of the cylinder (2) as a combustion chamber (54)(58) (a first combustion chamber and a second combustion chamber). As shown in FIG. 17, three pistons (7)(72)(73) can travel within the cylinder (2) each between a first location (8) and a second location (9). The fuel (56) and oxidizer (57) can be alternatingly introduced and combusted on opposed sides of each of the three pistons (7)(72)(73) defining four combustion chambers (54)(58)(74)(75). These examples are not intended to be limiting and various permutations and combinations in the number of cylinders (2), the number of pistons (7) within each cylinder (2) and the number of combustion chambers (54) within each cylinder (2) can provide a numerous and wide variety of embodiments of the invention which can operate in the same, similar or different fashion to that above-described. While each of the embodiments of the invention shown in FIGS. 15, 16, and 17, illustrate travel of the piston (7) in response to expanding gases from the combustion of a mixture of a fuel (56) and an oxidizer (57); the invention is not so limited, and embodiments of the invention can utilize any increasing fluid pressure (12) (or vacuum (53)) whether from a compressed liquid or gas source with timed introduction into the corresponding chambers (15) to generate travel of the piston (7) within the cylinder (2) or any other manner of generating travel in the piston (7) within the cylinder (2) including but not limited to turning the shaft (17) mechanically to correspondingly generate axial rotation and translation of the piston (7).

Figure 18:
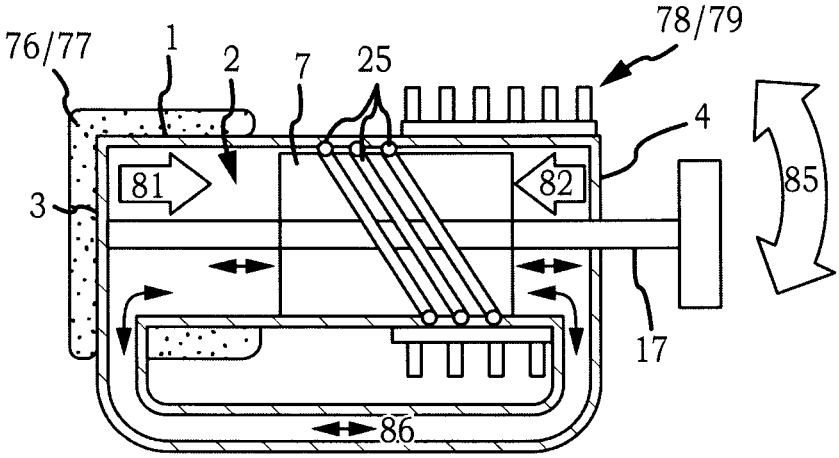
FIG. 18 is a cross section view which illustrates operation of a particular embodiment of the invention which utilizes a hot zone and a cold zone to heat and cool gases to induce travel of a piston within a piston chamber.

Now referring primarily to FIG. 18, which shows a particular non-limiting embodiment of the invention which generates travel in the piston (7) by providing a heated zone (76) proximate a first end (77) of the cylinder (2) and a cooled zone (78) proximate the second end (79) of the cylinder (2). The heated zone (76) can provide sufficient heat (80) to induce expansion of a first amount of gas (81) located within the corresponding first chamber (15) proximate the first end (77) of the cylinder (2). A second amount of gas (82) located in the second chamber (16) proximate the cooled zone (78) can be sufficiently cooled to contract the volume of the second amount of gas (82). The coordinated heating of the first amount of gas (81) and cooling of the second amount of gas (82) can drive the piston (7) from the first location (8) toward the second location (9) within the cylinder (2). The cooled second amount of gas (82) can be delivered to the heated zone (76) and the heated first amount of gas (81) can be delivered to the cooled zone (78). The piston (7) returns to the first location (8) and expansion of the first amount of gas (81) heated in the heated zone (76) again generates travel in the piston (7) toward the second location (9) within the cylinder (2).

As can be easily understood from the foregoing, the basic concepts of the present invention may be embodied in a variety of ways. The invention involves numerous and varied embodiments of an axially rotating free-piston engine.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of "a rotatable shaft" should be understood to encompass disclosure of the act of "rotating a shaft"—whether explicitly discussed or not—and, conversely, were there effectively disclosure of the act of "rotating a shaft", such a disclosure should be understood to encompass disclosure of "rotatable shaft" and even a "means for rotating a shaft." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

For the purposes of the present invention, ranges may be expressed herein as from "about" one particular value to "about" another particular value. When such a range is expressed, another embodiment includes from the one particular value to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint. In the absence of any express written value, "about" means within +/−10 percent of the numerical value indicated.

Moreover, for the purposes of the present invention, the term "a" or "an" entity refers to one or more of that entity unless otherwise limited. As such, the terms "a" or "an", "one or more" and "at least one" can be used interchangeably herein.

For the purposes of this invention the term "slidably engaged" means capable of movement over a surface.

Thus, the applicant(s) should be understood to claim at least: i) each of the axially rotating free-piston engines herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification and any patent application on which priority is claimed, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. An axially rotating piston device, comprising:

a housing which defines a cylinder having a length disposed between a first cylinder head and a second cylinder head;

a shaft rotationally journaled to at least one of said first cylinder head or said second cylinder head, said shaft having one of a spline or a groove extending along the longitudinal axis of said shaft;

a first piston disposed in said cylinder defining a first chamber and a second chamber within said cylinder, said first piston having an axial passage communicating between a first face and a second face, said axial passage having one of a spline or a groove extending along the longitudinal axis of said axial passage, said spline of said shaft or said spline of said axial passage mating with said groove of said shaft or of said groove of said axial passage allowing slidable mated relation of said first piston along the longitudinal axis of said shaft and fixed rotational engagement of said first piston and said shaft; and a first channel guide including a self aligning bearing set into said cylinder wall of said cylinder and a peg mounted in the inside race of said self aligning bearing;

a first annular channel having an elliptical path disposed in said first piston, said first channel guide engaging said annular channel, whereby occurrence of sliding engagement of said first piston along the longitudinal axis of said shaft generates axial rotation of said piston in said cylinder and a corresponding rotation of said shaft.

2. The axially rotating piston device of claim 1, wherein said spline and said groove comprise a plurality of splines correspondingly slideably mated with a plurality of grooves.

3. The axially rotating piston device of claim 1, wherein said first channel guide comprises two or more channel guides and said first annular channel correspondingly comprises two or more annular channels.

4. The axially rotating piston device of claim 1, further comprising:

a) a second annular channel disposed in mirror image relation to said first annular channel; and b) a second channel guide slidably engaging said second annular channel.

5. The axially rotating piston device of claim 1, a first inlet port opening into said first chamber.

6. The axially rotating piston device of claim 5, a first outlet port opening into said first chamber.

7. The axially rotating piston device of claim 6, a first inlet valve operatively associated with said first inlet port to alternately provide an open condition and a closed condition of said first inlet port.

8. The axially rotating piston device of claim 7, a first outlet valve operatively associated with said first outlet port to alternately provide an open condition and a closed condition of said first outlet port.

9. The axially rotating piston device of claim 8, an amount of fluid delivered through said first inlet port in said open condition to said first chamber, said first outlet port in said closed condition allowing said amount of fluid to act on said first face of said first piston to generate sliding engagement of said first piston along the longitudinal axis of said shaft.

10. The axially rotating piston device of claim 8, a second inlet port opening into said second chamber.

11. The axially rotating piston device of claim 10, a second outlet port opening into said second chamber.

12. The axially rotating piston device of claim 11, a second inlet valve operatively associated with said second inlet port to alternately provide an open condition and a closed condition of said second inlet port.

13. The axially rotating piston device of claim 12, a second outlet valve operatively associated with said second outlet port to alternately provide an open condition and a closed condition of said second outlet port.

14. The axially rotating piston device of claim 13, an amount of fluid delivered through said first inlet port in said open condition to said first chamber and delivered through said second inlet port in said open condition to said second chamber, said open condition of said first inlet port and said open condition of said second inlet port in alternate timed relation to allow said amount of fluid to alternately act on said first face of said first piston and said second face said first piston to generate sliding engagement of said piston in alternating opposite direction along the longitudinal axis of said shaft to generate axial rotation of said first piston in said cylinder and corresponding rotation of said shaft.

* * * * *